US009144276B2

(12) United States Patent
Ni

(10) Patent No.: US 9,144,276 B2
(45) Date of Patent: Sep. 29, 2015

(54) AUTOMATIC UMBRELLA

(71) Applicant: Su-Chen Ni, Taipei (TW)

(72) Inventor: Su-Chen Ni, Taipei (TW)

( * ) Notice: Subject to any disclaimer, the term of this patent is extended or adjusted under 35 U.S.C. 154(b) by 0 days.

(21) Appl. No.: 13/960,806

(22) Filed: Aug. 7, 2013

(65) Prior Publication Data

US 2015/0040954 A1 Feb. 12, 2015

(51) Int. Cl.
*A45B 25/14* (2006.01)
*A45B 25/16* (2006.01)

(52) U.S. Cl.
CPC ..... *A45B 25/143* (2013.01)

(58) Field of Classification Search
CPC ..... A45B 25/143
USPC ..... 135/20.3, 22, 25.4
See application file for complete search history.

(56) References Cited

U.S. PATENT DOCUMENTS 6,070,602 A * 6/2000 Ling Kuo ..... 135/25.4
8,684,018 B1 * 4/2014 Ni ..... 135/20.3
2014/0041701 A1 * 2/2014 Hsieh et al. ..... 135/22

FOREIGN PATENT DOCUMENTS

DE 202013103543 U1 * 8/2013
WO WO 2004056230 A1 * 7/2004

* cited by examiner

*Primary Examiner* — David R Dunn
*Assistant Examiner* — Danielle Jackson
(74) *Attorney, Agent, or Firm* — Leong C. Lei

(57) ABSTRACT

The automatic umbrella has an improved tube unit which contains a first tube, a second tube, and a third tube telescoping together. An inner plug is positioned inside the second tube. A reinforcing tube is housed in the second tube and capable of moving upward through the inner plug. The main spring has its top end against the reinforcing tube, and its bottom end in a lower part of the first tube. The secondary spring is inside the third tube with a top end against the inner plug of the top nest and a bottom end against the inner plug of the second tube. The tube unit enjoys enhanced resilience when the automatic umbrella is opened. When the umbrella is closed, two sets of springs are compressed at separate instants and their resilience cancels each other indirectly. The strength to close the umbrella is therefore reduced.

1 Claim, 3 Drawing Sheets

AUTOMATIC UMBRELLA

TECHNICAL FIELD OF THE INVENTION

The present invention is generally related to automatic umbrellas, and more particular to an automatic umbrella with an improved tube structure.

DESCRIPTION OF THE PRIOR ART

The tube of an automatic umbrella is automatically expanded by an opening spring inside the tube. However, as there is limited space in the tube, opening spring usually fails to provide adequate resilience. For example, the opening spring cannot have a larger diameter (therefore, a strong resilience) than that of the tube. To ensure the bullet head can be moved normally, the opening spring cannot have a larger wire diameter (therefore, a strong resilience). Additionally, since there is limited space after the tube is collapsed, the opening spring cannot have a larger number of turns. With the foregoing and other factors, a conventional automatic umbrella usually suffers insufficient resilience from its opening spring and as such the tube sometimes cannot be completely expanded. Furthermore, there is usually a single opening spring whose length is about the length of the tube structure. Due to its more extended length, compressing the opening spring requires significant strength, and a user has to exert great force so as to collapse the automatic umbrella in a single attempt. If the user is not careful, the compressed opening spring would bounce to restore the tube, often injuring the user's hand or other body parts. It is obvious that there is still a lot of room for an improved automatic umbrella.

SUMMARY OF THE INVENTION

Therefore, a major objective of the present invention is to provide a novel automatic umbrella with enhanced resilience to its tube structure.

The automatic umbrella has an improved tube unit which contains a first tube, a second tube, and a third tube telescoping together. An inner plug is positioned inside the second tube. A reinforcing tube is housed in the second tube and capable of moving upward through the inner plug. The main spring has its top end against the reinforcing tube, and its bottom end in a lower part of the first tube. The secondary spring is inside the third tube with a top end against the inner plug of the top nest and a bottom end against the inner plug of the second tube. The tube unit enjoys enhanced resilience when the automatic umbrella is opened. When the umbrella is closed, two sets of springs are compressed at separate instants and their resilience cancels each other indirectly. The strength to close the umbrella is therefore reduced.

An inward ring is positioned inside a top end of the reinforcing tube so that the main spring has its top end against a bottom side of the inward ring. An outward ring is positioned around a bottom end of the reinforcing tube, so that the reinforcing tube is prevented from moving entirely out of the second tube by the blocking of the inner plug of the second tube.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
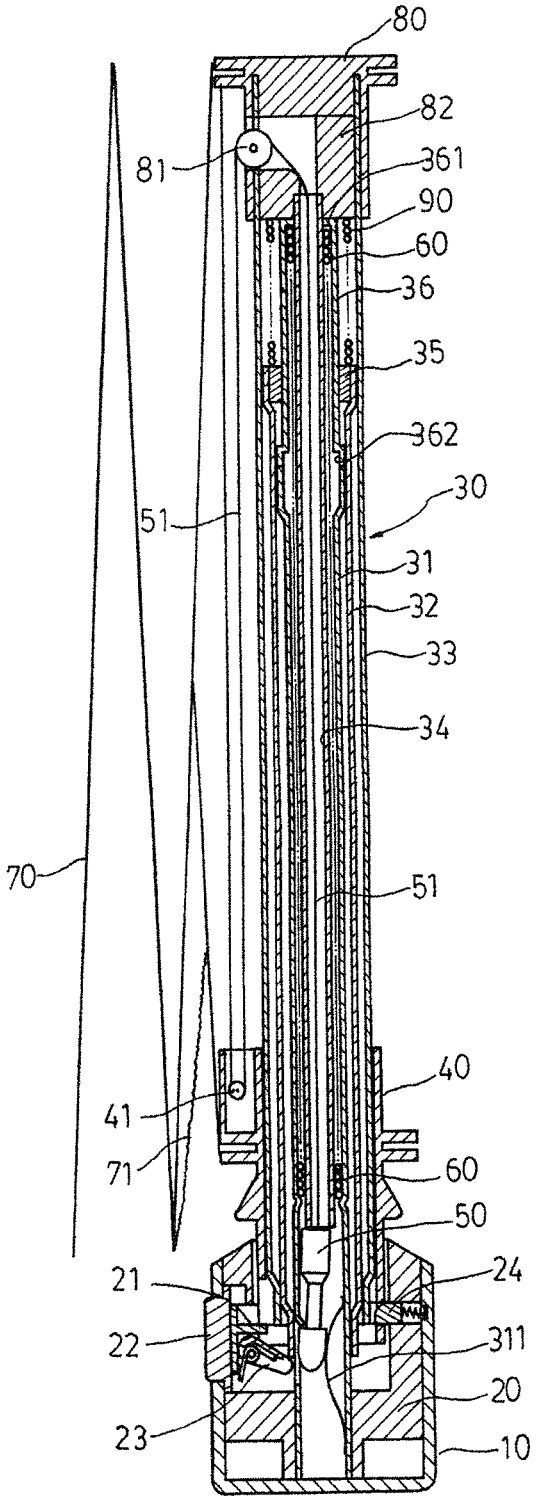
FIG. 1 is a schematic diagram showing an automatic umbrella according to an embodiment of the present invention when it is collapsed.

An automatic umbrella according to an embodiment of the present invention as a three-fold umbrella and as illustrated in FIG. 1 contains a handle 10, a control unit 20, a tube unit 30, a runner 40, a bullet head 50, a main spring 60, a number of ribs 70, closing springs 71, a top nest 80 having an inner plug 82, and a secondary spring 90. The control unit 20 is housed inside the handle 10 and contains a control ring 21 in a hollow body (not numbered), a button 22 exposed from the circumference of the handle 10, a control pin 23 beneath a side of the control ring 21, and a locking pin 24 on the control ring 21's circumference at the other side of the control pin 23. The tube unit 30 contains a first tube 31, a second tube 32, and a third tube 33 telescoped together. An upper end of the third unit 33 is fixedly joined to the top nest 80. An inner plug 35 is positioned inside a top end of the second tube 32. A vertically movable reinforcing tube 36 is housed in the second tube 32. The reinforcing tube 36 can move upward through the inner plug 35 and extend outside the second tube 32. An inward ring 361 is positioned inside a top end of the reinforcing tube 36. An outward ring 362 is positioned around a bottom end of the reinforcing tube 36, so that the reinforcing tube 36 is prevented from moving entirely out of the second tube 32 by the blocking of the inner plug 35 of the second tube 32. A bottom end of the first tube 31 is fixedly joined to the hollow body of the control unit 20. The main spring 60 has its top end against a bottom side of the inward ring 361, and its bottom end in a lower part of the first tube 31. The secondary spring 90 is inside the third tube 33 with a top end against a bottom side of the inner plug 82 of the top nest 80 and a bottom end against a top side of the inner plug 35 of the second tube 32. The runner 40 is threaded by the tube unit 30 with an inner pulley 41 at a side. The ribs 70 are radially extended from between the top nest 80 and the runner 40, and each rib 70 is pin-joined to a closing spring 71. The bottom side of the inner plug 82 of the top nest 80 is fixedly joined to an inner tube 34 whose bottom end threading through the inner plug 35 and the reinforcing tube 36. A pulley 81 is positioned in the inner plug 82 and has a side exposed outside the third tube 33 and the top nest 80. A string 51 has one end fixedly connected to the top nest 80, runs around the pulley 41 of the runner 40 and the pulley 81, and has the other end fixedly joined to a tip of the bullet head 50 through the inner tube 34.

As illustrated in FIG. 1, when the automatic umbrella is collapsed, the reinforcing tube 36 of the second tube 32 has its top end against the bottom side of the top nest 80. The main spring 60 is compressed in the first tube 31 and the reinforcing tube 36 by the reinforcing tube 36. The secondary tube 90 is compressed in the third tube 33 between the bottom side of the inner plug 82 of the top nest 80 and the top side of the inner plug 35. The runner 40 is locked by the locking pin 24 of the control ring 21. The control pin 23 is tilted downward by the push from a bottom end of the second tube 32. The bullet head 50 is pushed by the inner tube 34 and pressed by an elastic piece 311 of the first tube 31 so that the bullet head 50 is locked in the first tube 31.

Figure 2:
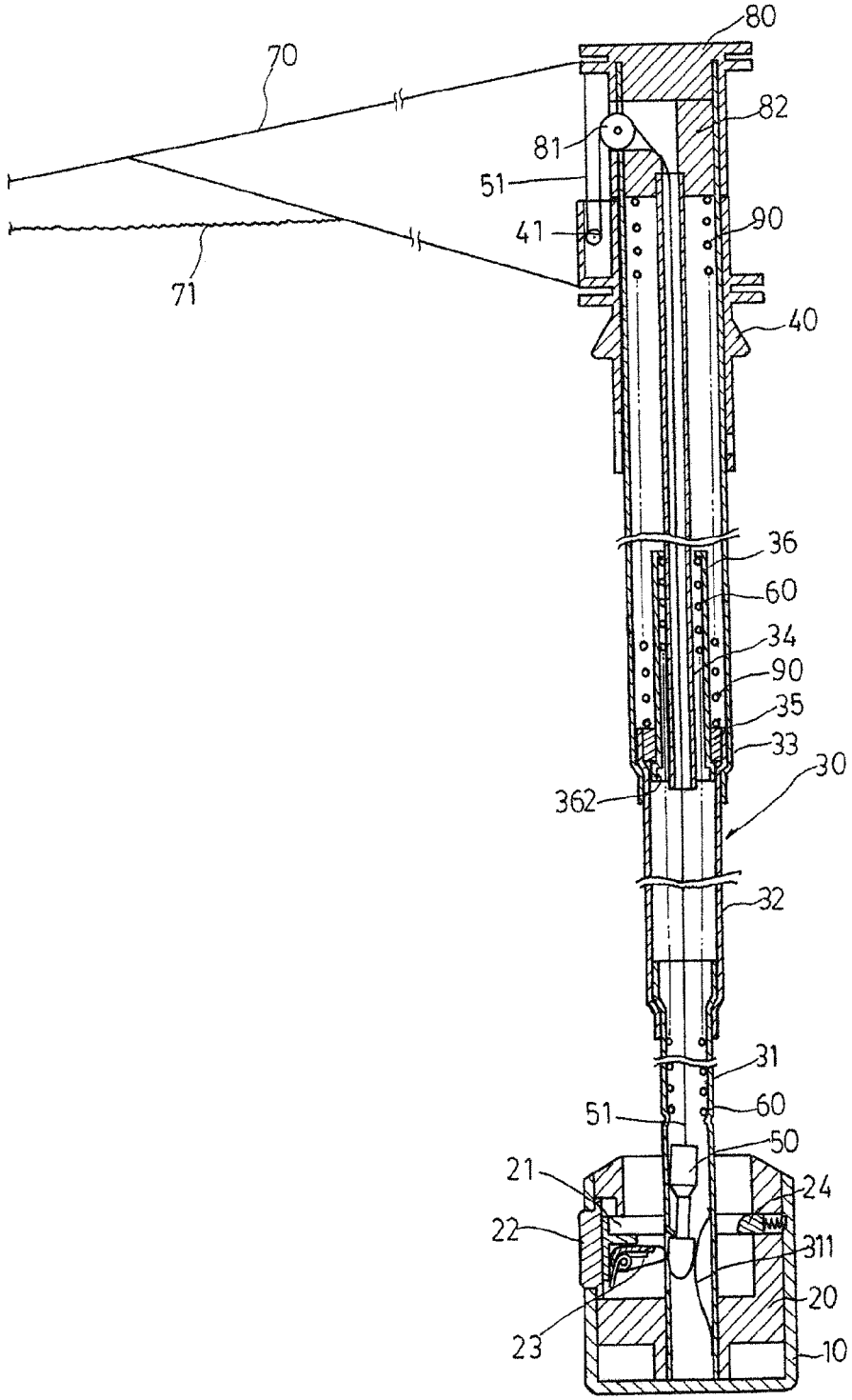
FIG. 2 is a schematic diagram showing the automatic umbrella of FIG. 1 when it is opened.

As illustrated in FIG. 2, to open the automatic umbrella, the button 22 is pressed and the control ring 21 is pushed inward so that the runner 40 escapes the locking of the locking pin 24. Then, under the resilience of the main spring 60 in the tube unit 30, the reinforcing tube 36 is pushed upward, and the second tube 32 is pulled upward by the outer ring 362 at the bottom of the reinforcing tube 36. The third tube 33 is also pushed upward by the resilience of the secondary spring 90. In the meantime, the bullet head 50 is still locked in the first tube 31. The runner 40 is pulled upward by the string 51 through the pulley 81 and the ribs 70 are fully expanded, thereby stretching the closing springs 71. The control pin 23 is restored to a levelled state against the bullet head 50.

Figure 3:
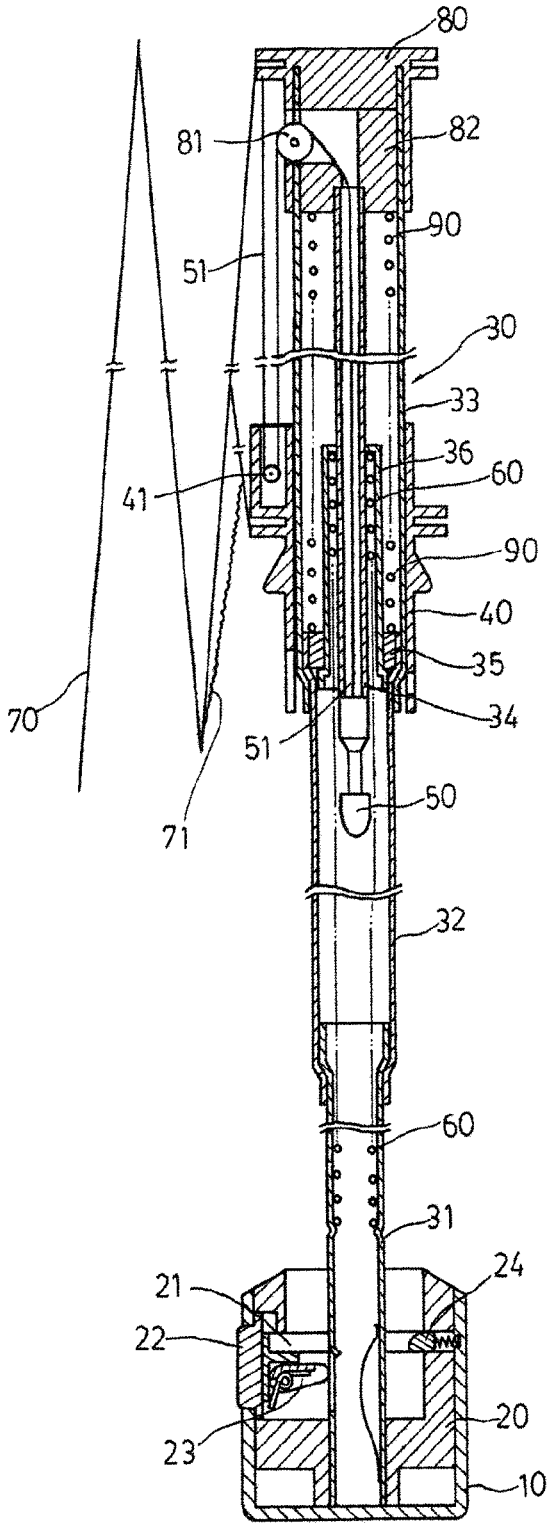
FIG. 3 is a schematic diagram showing the automatic umbrella of FIG. 2 when it is collapsed.

As illustrated in FIG. 3, to close the automatic umbrella, the button 22 is pressed again and the control pin 23 pushes the bullet head 50 to release it within the first tube 31. The pull on the string 51 is as such also released. Then, under the resilience of the closing springs 71, the ribs 70 are retracted and folded automatically. The runner 40 is moved downward and the tube unit 30 is contracted, thereby restoring the automatic umbrella to the state shown in FIG. 1.

The gist of the present invention lies in the reinforcing tube 36's upward extension from the second tube 32. As such, the main spring 60 is extended from the first tube 31 to above the second tube 32. The secondary spring 90 configured between the second tube 32 and the third tube 33 is as such extended. In other words, the length of the springs is effectively increased. The automatic umbrella therefore enjoys enhanced resilience to the tube unit 30 when the automatic umbrella is opened. When the automatic umbrella is closed, two sets of springs are compressed at separate instants and their resilience cancels each other indirectly. The strength required to close the automatic umbrella is therefore reduced.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An automatic umbrella, comprising:

a handle;

a control unit housed inside the handle comprising a control ring, a button, a control pin, and a locking pin;

a tube unit comprising a first tube, a second tube, and a third tube telescoping together;

a top nest having a first inner plug, a bottom side of the top nest fixedly joined to a top end of the third tube;

an inner tube fixedly joined to a bottom side of the first inner plug of the top nest;

a runner threaded by the tube unit;

a bullet head inside the tube unit;

a plurality closing springs;

a plurality of ribs radially extended from between the top nest and the runner, each rib configured with one of the plurality of closing springs;

a main spring; and a secondary spring;

wherein a second inner plug is positioned inside a top end of the second tube;

a vertically movable reinforcing tube is housed in the second tube and capable of moving upward through the first inner plug of the second tube and extending outside the second tube;

the main spring has its top end against the reinforcing tube, and its bottom end in a lower part of the first tube, so that the main spring is held between the first and second tubes and has an extension length exceeding a sum of the first and second tubes in an expanded condition of the first and second tubes; and the secondary spring is inside the third tube with a top end against a bottom side of the first inner plug of the top nest and a bottom end against a top side of the second inner plug of the second tube.

* * * * *